US005094052A

United States Patent [19]

Gudmundsson et al.

[11] Patent Number: 5,094,052

[45] Date of Patent: Mar. 10, 1992

[54] BUILDING WALL CONSTRUCTION

[76] Inventors: Edgar Gudmundsson, Imker 4, 6641 EV Beuningen, Netherlands; Oli J. Asmundsson, Thorsgata 24, 101 Reykjavik, Iceland

[21] Appl. No.: 568,164

[22] Filed: Aug. 16, 1990

Related U.S. Application Data

[63] Continuation-in-part of Ser. No. 41,821, Apr. 21, 1987, abandoned.

[51] Int. Cl.[5] ..... F04B 2/32; F04B 2/78

[52] U.S. Cl. ..... 52/238.1; 52/481; 52/595; 52/763; 52/779

[58] Field of Search ..... 52/238.1, 243, 763, 52/481, 777, 778, 779, 593, 595, 483, 488

[56] References Cited

U.S. PATENT DOCUMENTS

| | | | |
|---|---|---|---|
| 1,458,652 | 6/1923 | Gooding | 52/238.1 |
| 3,320,710 | 5/1967 | Byssing | 52/778 |
| 3,349,529 | 10/1967 | Byssing | 52/481 |
| 3,844,085 | 10/1974 | Marchello | 52/593 |
| 4,443,991 | 4/1984 | Mieyal | 52/481 |

FOREIGN PATENT DOCUMENTS

| | | | |
|---|---|---|---|
| 46629 | 3/1974 | Australia | 52/779 |
| 801050 | 12/1950 | Fed. Rep. of Germany | 52/583 |

*Primary Examiner*—Michael Safavi

*Attorney, Agent, or Firm*—Richard C. Litman

[57] ABSTRACT

A building construction includes a wall, floor or ceiling assembly wherein a pair of walls or the like each include adjacent wallboards having edge formations defining a mating tongue and groove configuration. The wall pairs are supported in a stable manner by metal posts having a variety of edge flange configurations and which are captively secured within the confines of each wallboard tongue and groove joint. Tight joints between adjacent wallboards and the posts are insured by the formation of one or more kerfs in the area of the wallboard joints and which engage portions of the entrapped posts to provide enhanced rigidity throughout the wall height. By angling the post edge flanges outwardly and providing correspondingly angled wallboard kerfs, maximum structural integrity is achieved with use of minimum thickness wallboards. Ease of assembly of the wallboards to an erected post is facilitated by the formation of resilient struck-out tabs positioned to guide and engage the wallboard inner faces and which also serve to retain insulative strips juxtaposed each face of the post webs. Tip portions on these tabs subsequently engage and retain insulation batts as placed between adjacent erected posts. Stacking of the posts in a stable, compact manner is achieved in view of the openings as formed by the struck-out tabs as well as adjacent openings of a configuration permitting insertion therethrough of the tabs of a next adjacent post when stacked.

22 Claims, 7 Drawing Sheets

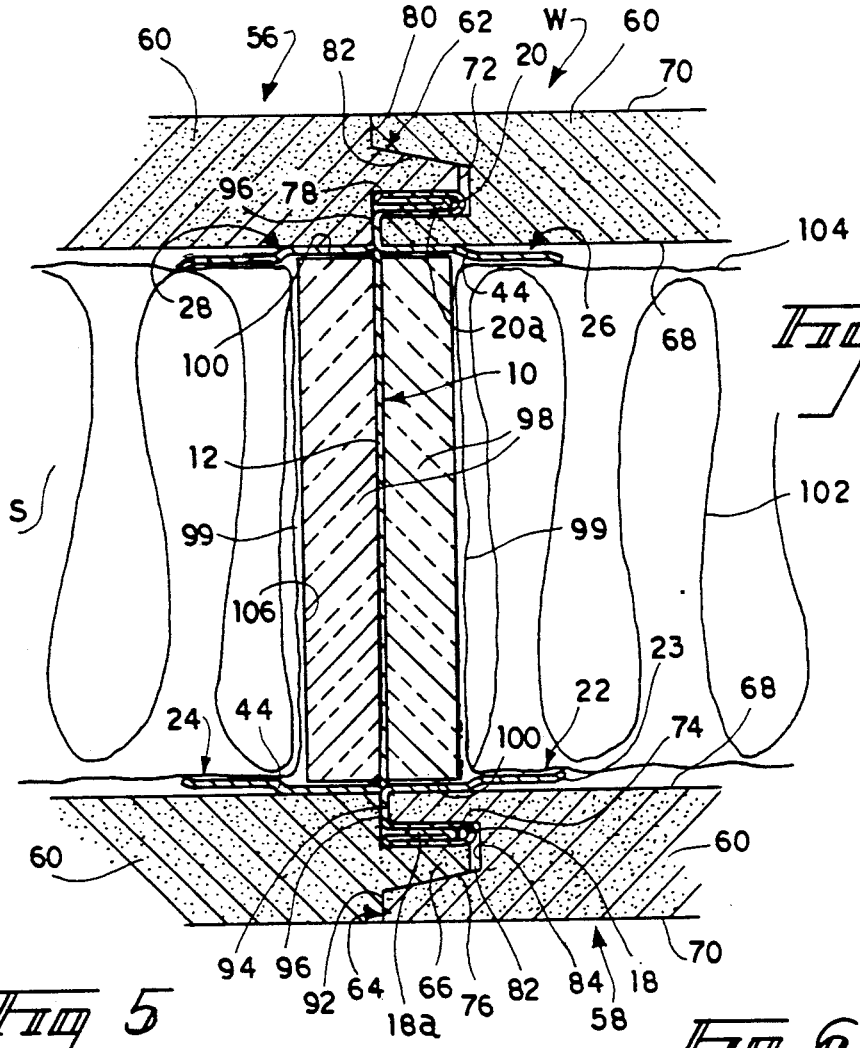
Fig 4
Fig 5
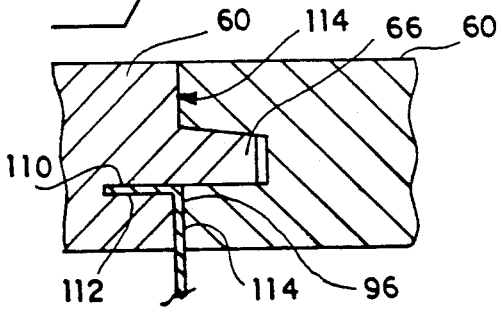
Fig 6
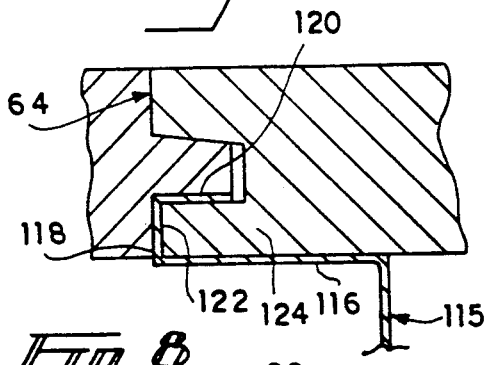
Fig 7
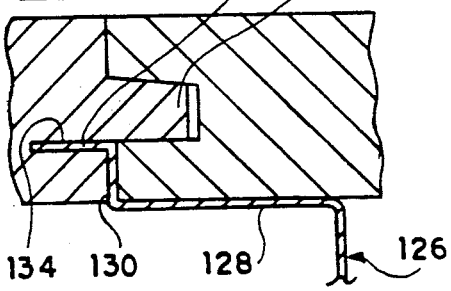
Fig 8
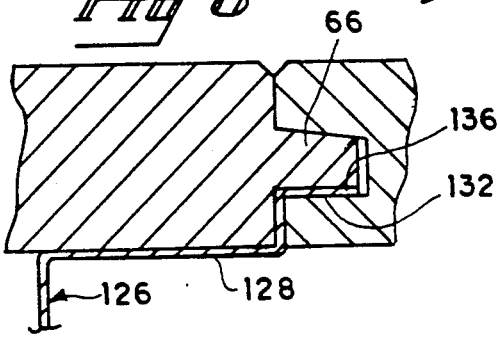

Fig 13
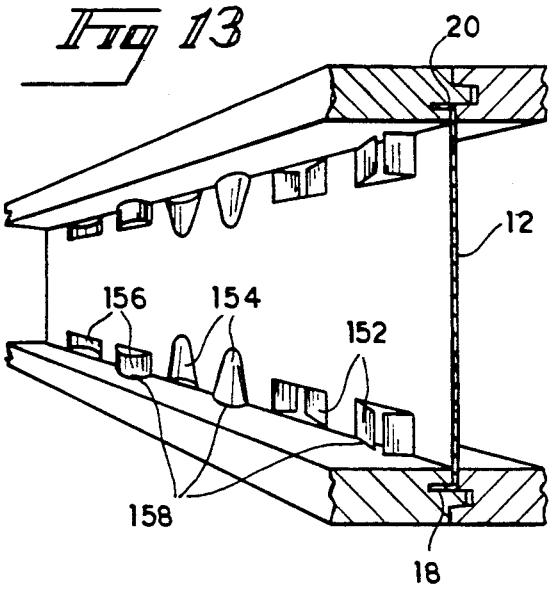
Fig 15
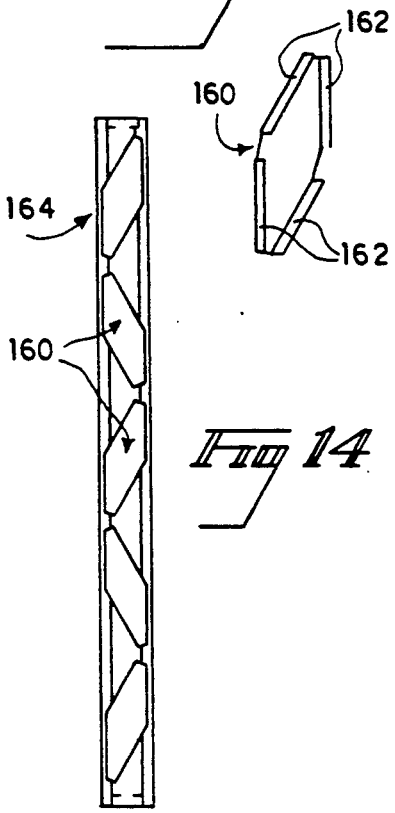
Fig 14
Fig 16
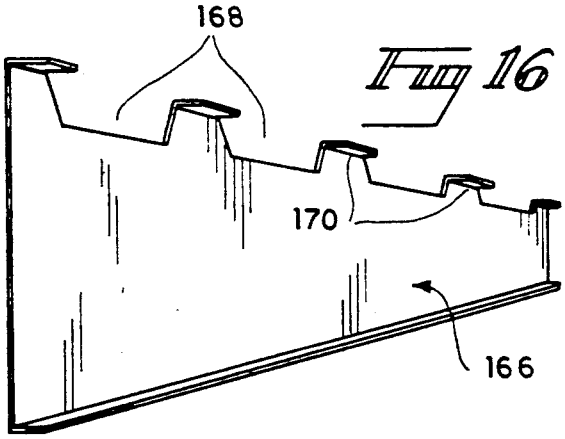
Fig 17
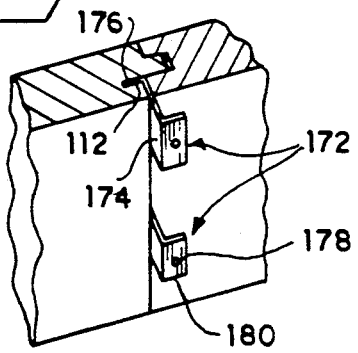
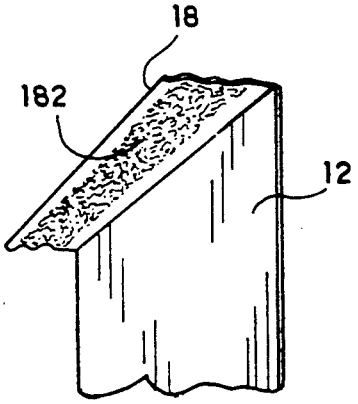
Fig 18

BUILDING WALL CONSTRUCTION

CROSS-REFERENCE TO RELATED APPLICATION

This is a continuation-in-part of our prior application Ser. No. 041,821 filed on Apr. 21, 1987.

FIELD OF THE INVENTION

This invention relates generally to building construction and more particularly, to an improved wall, floor or ceiling assembly comprising specifically configured channels or posts as utilized in combination with specifically constructed wallboards and which may be employed to rapidly erect walls or the like having improved resistance to sound and heat transmission.

BACKGROUND OF THE INVENTION

The use of wallboards to finish off the enclosures of a building has long been recognized as the most expedient manner of erecting the final walls of enclosures, regardless of the ultimate finish, such as wallpaper or paint. Generations ago, a building construction was not considered truly permanent unless its walls were of plaster. Such construction required considerably more skill than that readily available today. Additionally, substantially more time and expense would be called for to provide plastered walls as initially, an accurately installed lath must be provided before plasterers apply successive green and finish coats of plaster.

Today, most residential and commercial construction calls for at least interior walls which are of premanufactured wallboard such as, gypsum board or plaster board and which are rapidly erected by merely driving suitable fasteners through abutting edges of the boards and into wood studs or metal channels or posts underlying the joints between adjacent wallboards. Since the sole attachment of such wallboards is by means of the driven fasteners, such fasteners must be applied at very close intervals, not only adjacent each abutting side edge but also, along the top and bottom edges of the wallboards. Each joint between abutting wallboards is then covered with tape and a plaster compound which is thereafter smoothed or sanded prior to the application of paint or other wall covering. Since most wallboards lack any interlocking feature in the area of their abutment, any deformation of the underlying mounting surfaces of the posts or studs will be transmitted as uneven or non-planar outer surfaces on the fastened wallboards, thereby calling for excessive patching plaster in an effort to disguise such irregularities.

Thus, it is desirable that a wall assembly permit of rapid erection, with minimum labor and tools and fasteners, while insuring of a positive, rigid interlock between two sides of mating, co-planar wallboards and intermediate metal posts or studs. Such an assembly should exhibit a high fire rating with the cooperating posts discouraging the conduction of heat from the wallboards on one side of the posts to those wallboards on the other side thereof. Additionally, it is preferable that the posts include means to positively retain insulation batts installed within walls according to this invention, with these same means also serving to positively guide and support adjacent wallboards during their assembly and further serving to retain an assembly of stacked posts of similar configuration.

DESCRIPTION OF THE RELATED ART

The broad concept of a wall assembly including a metal stud or post with flanges or struck-out portions providing engagement means cooperating with interlocking wallboards, will be found in U.S. Pat. Nos. 3,320,710 and 3,349,529 both issued to Byssing. The former patent discloses multi-layered wallboards cooperating with Z-shaped studs having struck-out portions engageable with the inner surfaces of the wallboards while the latter patent shows a further example of multi-layered wallboards and which are supported by C-shaped studs having struck-out portions adapted to engage mounting elements attached to a sill channel. Wallboards having a tongue and groove interlock cooperating with the flange of an intermediate channel member will be found in German Pat. No. 801,050 dated December 1950. No suggestion is seen in any of the above prior art of the instant combination utilizing specifically configured posts and wallboards to assemble a wall or the like having the improved properties set forth hereinbelow.

SUMMARY OF THE INVENTION

By the present invention, an improved wall assembly is provided including posts or studs having a central web bounded by one or more integral flanges along both vertical edges and which are configured to cooperate with a corresponding number of kerf(s) included in an interlocking joint construction as formed by the opposing edges of adjacent wallboards as mounted upon the flanges on both sides of each stud central web. Preferably, the wallboard interlock is provided by means of a mating tongue and groove formation on opposed edges of adjacent wallboards and the kerf(s) as formed for reception of the stud flange(s) may be provided as a relief area in either one or both of the cooperating wallboards. In any case, one or more flanges as provided on each side of each post or stud are initially inserted into the aforementioned kerf(s) associated with one of the wallboards, after which the second, cooperating wallboard is axially or coplanarly moved into a mating position with the first installed wallboard, to complete the joining of two wallboards to each side of each post and provide a positive captive interlock between the components. By inclining the post flanges away from the intermediate web, at an angle greater than 90 degrees, and then forming the relief areas or kerfs in the wallboards at a similar angle, a minimum thickness of the wallboards may be maintained, without sacrifice to the strength of the resultant joint arrangement.

Following the spanning of two or more posts with one or more wallboards on any one side of the respective posts, it will be understood that one wall of the wall assembly will be at least partially installed and thereafter, suitable sound and heat insulating material may be installed. Integral tabs struck-out from the material of the present post webs provide means facilitating not only the initial alignment, guidance and retention of the wallboards relative the posts but also, provides resilient snap-fitting means serving to receive and retain relative thin strips of rigid insulative material juxtaposed and coextensive with both faces of the post webs. These rigid strips may be installed before or after the first wallboards are mounted and the same tabs retaining these strips in contact with both sides of the post webs will be understood to extend beyond the affixed strips and may be used to additionally retain the opposite ends of suitable insulative batts, sized to span the remaining lateral space between adjacent erected posts. In this manner, maximum sound absorption and fire protection will be provided as the insulative strips act as a heat sink to retard and dissipate heat applied to the face of any one wall of the wall assembly, thus reducing or delaying the transmission of such heat to the opposite wall thereof. At the same time, the frictional engagement as applied by the post tabs to the ends of each insulative batt, will serve to retain the insulation in place should one of the assembly walls deteriorate in the case of fire, thereby further delaying a total failure of the wall assembly during a fire.

Energy transmission from one post flange to the other is further retarded by the inclusion of critically located openings in the post webs and which provide multiple breaks in the conductive mass of the webs, along any tranverse axis thereacross.

A third function of the above mentioned post tabs is to facilitate the stacking or nesting of a plurality of similarly configured posts, such as for shipping and/or storage. As mentioned above, these tabs are struck-out from the post webs thereby producing adjacent cut-out portions. The configuration of the tabs and the shape of the periphery of the corresponding cut-outs is selected to readily accommodate the insertion of at least the tip portion of the tabs of one post within the cut-outs of adjacent posts when stacked upon one another. This arrangement results in a reduction of the overall height of a plurality of stacked posts and also longitudinally and laterally interlocks the posts to preclude tumbling down of a stacked array of the posts.

Accordingly, one of the objects of the present invention is to provide an improved wall assembly including opposed wallboards united by metal posts having flanges captively engaged within kerfs formed adjacent the edges of interlocking wallboards.

Another object of the present invention is to provide an improved wall assembly including opposed walls each comprising joined wallboards having mating tongue and groove edge formations with intermediate posts provided with flanges captured within these formations as well as post offset portions engageable with the inner faces of the wallboards.

A further object of the present invention is to provide an improved wall assembly including opposed walls each joined by interlocking edge formations with intermediate posts having two or more flanges or web portions captively retained within each joint as formed by each pair of adjacent wallboards.

Still another object of the present invention is to provide an improved wall assembly including posts having flanges captively engaged within joints as formed by interlocking edge formations of adjacent wallboards with struck-out resilient tabs on each post central web engaging the wallboard inner faces as well as removably retaining strips of insulative material juxtaposed both faces of the post webs.

Another object of the present invention is to provide an improved wall assembly including intermediate posts having flanges and web portions captively engaged within tongue and groove joints between opposed walls as formed by wallboards and resulting in a rigid interlocked assembly avoiding the necessity of separate fasteners through the wallboards into the posts.

A further object of the present invention is to provide an improved wall assembly including opposed walls formed by wallboards having interlocking edge joints captively retaining flanged intermediate posts and wherein the post central webs are provided with struck-out tabs serving to retain insulative batts installed between adjacent posts.

Another object of the present invention is to provide an improved wall assembly including posts having flanges captively engaged within interlocking joints between adjacent wallboards, with the post central webs having struck-out tabs and adjacent apertures allowing of stacking of the posts in a partically nested condition with each tab disposed within an aperture of the next adjacent post.

Still Another object of the present invention is to provide an improved wall assembly including two walls formed by interlocking wallboards and joined to intermediate posts having flanges captively engaged within the joints of adjacent wallboards, with the post central webs having struck-out and cut-out portions interrupting the transverse extent of the posts substantially throughout their length to provide a temperature break between the two walls.

Another object of the present invention is to provide an improved wall assembly including opposed walls transversely joined by posts having flanges captively interfitted within joints between adjacent wallboards with the posts having inner flanges flushly supporting the inner surfaces of the walls throughout their height.

A further object of the present invention is to provide an improved wall assembly including opposed walls formed by wallboards having interlocking edge joints connected by posts provided with end flanges disposed at angles greater than 90 degrees to an intermediate web and insertable within similarly angled kerfs formed within the wallboards.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 4 is a horizontal sectional view of the post of FIGS. 1–3 as assembled with two walls to form a wall assembly according to the present invention;

FIG. 5 is a fragmentary sectional view of a post as assembled with wallboards having an alternative joint construction;

FIGS. 6–9 are fragmentary sectional views depicting further alternative post and wallboard joint constructions;

FIG. 13 is an end sectional view, illustrating the use of the present assembly to form a floor or ceiling, wherein the post serves as a joist and depicts various configurations of struckout formations providing spaced support for the wallboards;

FIG. 14 is a side elevation of an alternative post;

FIG. 15 is an enlarged perspective view of the diamond shaped member as used to form the lattice arrangement of the post of FIG. 14;

FIG. 16 is a perspective view of a modified post having removed areas to reduce temperature conduction as when used with an exterior wall;

FIG. 17 is a partial perspective view of an embodiment wherein a plurality of individual members replace a single full-length post;

FIG. 18 is a fragmentary end perspective view illustrating the inclusion a roughened surface to the post flange to increase the effectiveness of an applied adhesive thereto;

Similar reference characters designate corresponding parts throughout the several figures of the drawings.

DESCRIPTION OF THE PREFERRED EMBODIMENTS

In general, the wall assemblies of the present invention will be understood to comprise any of variously configured studs or posts having one or more flanges along their opposite edges and which are adapted to cooperate, in an interfitting manner, with tongue and groove joints as provided by the adjacent edges of wallboards forming two walls combined with the intermediate posts. Although primarily shown as defining vertically erected wall assemblies, either interior or exterior, the present assemblies are readily adaptable to the formation of floors or ceilings. In all instances, the unique construction of the posts and wallboard joints permits the rapid erection of an entire wall assembly in a most economical manner and with far fewer separate fasteners than heretofore required and results in an extremely rigid and stable assembly in view of the captive interlock between the post flanges and the wallboard joints.

Figure 1:
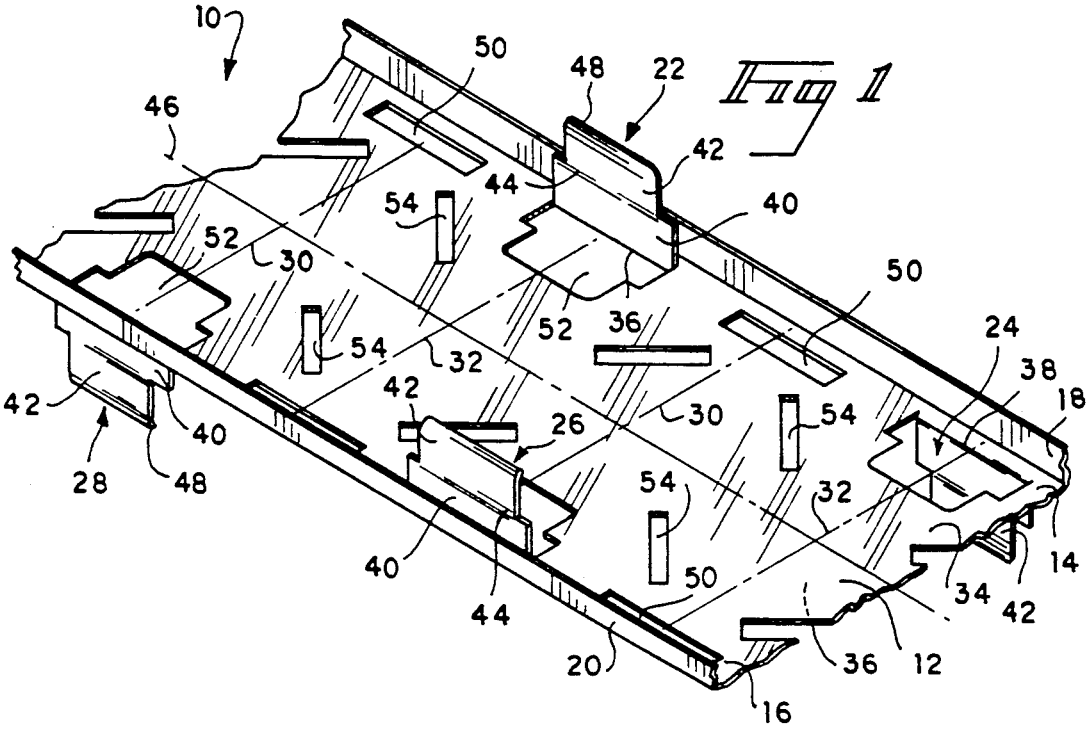
FIG. 1 is a perspective view of one form of post or stud as utilized in the present invention.
Figure 2:
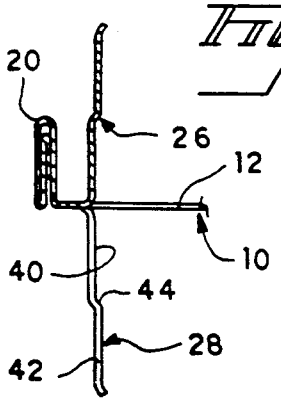
FIG. 2 is a partial end elevation of the post of FIG. 1.
Figure 3:
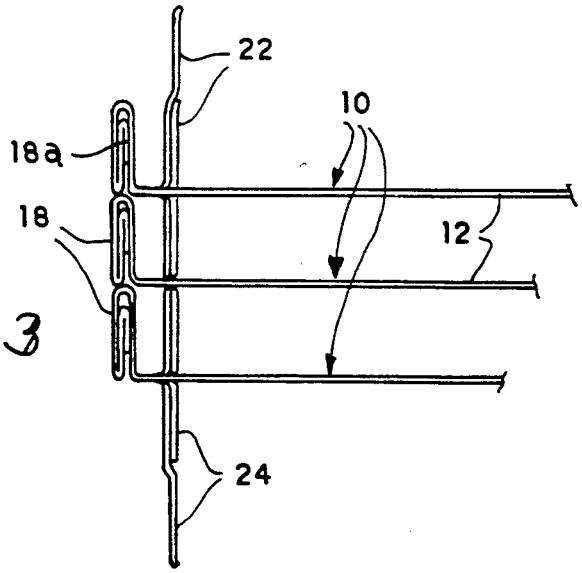
FIG. 3 is an end elevation illustrating a stacked array of posts according to FIGS. 1 and 2.

A typical stud or post 10 according to the present invention is shown in FIGS. 1-3. In all embodiments of the posts, any suitable material may be employed in their manufacture. From the standpoint of strength, cost and ease of fabrication, sheet metal is a logical choice and preferably a suitable galvanized steel is used. By providing the posts in a variety of widths, any of the common wall thicknesses may be accommodated. Typically, walls are designed as either 100 mm (4"), 125 mm (5") or 150 mm (6") thick. As the usual wallboard stock is available in either ½" and 5/8" thicknesses it will follow that by providing the present posts in six alternative widths, all possible combinations of wall and wallboard thicknesses may be accommodated under the present invention and in any one instance, the same structural features will be evident.

Figure 2A:
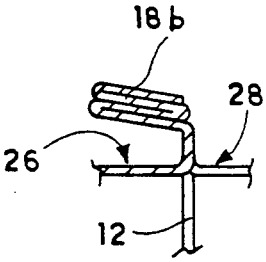
FIG. 2A is a view similar to FIG. 2, illustrating a variation of the folded post flange.

Each post 10 comprises a unitary element fabricated from constant thickness stock to provide a flat central web 12 having opposite lateral edges 14,16 respectively joined to end flanges 18,20 disposed normal to the web 12. To increase the rigidity of the post as well as to reduce the rate of heat transmittance from one flange 18 to the other 20, the flanges may comprise multiple layers of the metal stock as formed by twice double-folding the material upon itself during fabrication to arrive at the construction as shown most clearly in FIGS. 2-4. Additionally, these end flanges may be accordion or Z-folded as at **18*b* in FIG. 2A**. This latter arrangement will be understood to maximize the material distance from the outermost surface of one such flange, to the outermost surface of the opposite such flange, thereby providing the greatest time lag for any applied heat to migrate from one flange to the other. It will be appreciated that any of the post variants described hereinafter may optionally include such thickened end flanges.

At this point it will be appropriate to note that the end flanges in each of the drawing views are quite narrow relative those flanges evident in conventional wall assembly posts. A usual post flange is approximately 40 mm wide while the instant flanges 18,20 are preferably less than ⅓ that dimension, or even down to 6 mm wide. In this manner, less contact area will be exposed to heat thereby reducing the conduction of energy from one flange to the opposite flange. This alone, reduces heat transmission by over 20% between opposed wall surfaces employing the posts described herein and which are configured to provide a fire resistant rating of class A-60.

Before describing the cooperation of the post 10 with the interlocking wallboards, other structural features of the post may be related at this point as it will be understood that these other features may be practiced with any of the later described post embodiments. As will be seen from FIG. 1 of the drawings, a plurality of tabs 22,24,26,28 project outwardly from the post web 12 adjacent the respective flanges 18,20 but spaced slightly inwardly of the web edges 14,16 for reasons which will become obvious hereinafter. The tabs will be seen to project from the post in a staggered manner. This staggered relationship will be apparent when viewing the post from either of two directions. That is, when the web 10 is viewed in plan, the tabs 26,28 adjacent one flange 20, are disposed along transverse axes 30,30 which are intermediate the transverse axes 32,32 passing through the tabs 22,24 located adjacent the other flange 18. Likewise, if one were to view the post from the side of either flange 18 or 20, then alternate tabs adjacent that flange will be seen to project from opposite faces of the post web 12. Considering the tabs 26,28 of FIG. 1, the tab 26 projects from the web inside face 34 while the tab 28 projects from the web outside face 36.

Figure 4A:
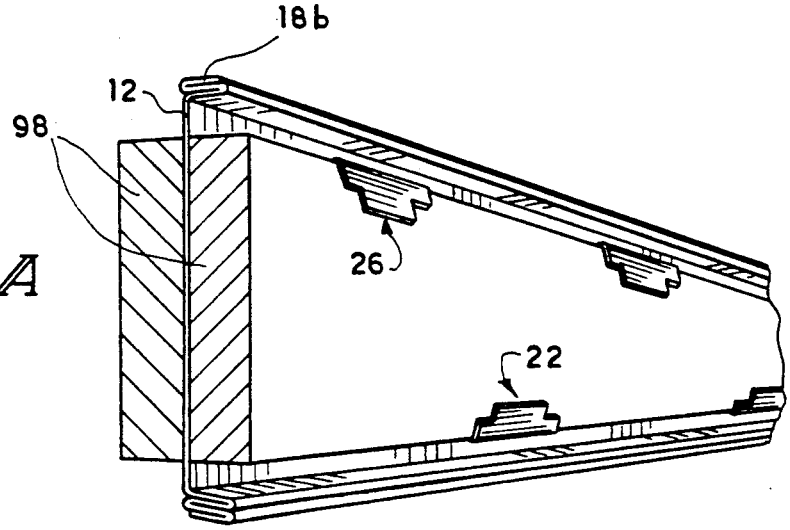
FIG. 4A is perspective view of an assembly similar to that as shown in FIG. 4.

The foregoing tabs are an integral part of the post as they are punched or struck-out from the material of the web 12 and bent substantially 90 degrees, along the hinge lines 38, spaced inwardly of the adjacent flange 18 or 20. Each tab includes a base portion 40 which defines the maximum width of the tab when viewed in elevation and which preferably projects from the hinge line 38 a distance comparable to the width of the flanges 18,20. Each tab base portion 40 is joined to a tab tip 42 by means of an inward bend 44 such that the tips 42 are disposed in a plane slightly inwardly offset from the base portions 40, toward the web centerline 46. With the insulative strips 98 properly sized, the outer faces 99 thereof will be seen to be retained substantially flush against the post web 12 by the inward bend 44 of the oppositely disposed sets of post tabs. Further positive retention of the strips 98 may be assured by physically deforming the tab tips 42 inwardly as shown in FIG. 4A. Two other points should be noted with respect to the tab tips 42. These elements are narrower than the attached base portions 40 and each terminates in a slightly rounded or inturned distal edge 48.

The post web 12 will be seen to include an elongated slot or opening 50 transversely opposed each tab and which defines an axial length no less than the width of the tab base portions 40. Thus each transverse axis 30 or 32 passing through the center of the tabs will bisect one of the elongated slots 50. This construction permits the stacking of a plurality of the posts 10 in the manner shown in FIG. 3 and whereupon, each tab tip portion 42 is freely insertable through an opening 50 as provided in both the next higher and lower post. By longitudinally staggering successive posts 10, one is always assured of having a set of equi-spaced tab tips 42 accessible to an equal number of equi-spaced elongated openings 50. This results in a stacked array of posts such as in FIG. 3, exhibiting an enhanced longitudinal and transverse stability.

The aforementioned elongated openings 50, as well as the oppositely disposed openings 52 formed as a result of the struckout tabs, support an additional function during the subsequent use of the posts as set forth herebelow. These openings serve as temperature breaks as heat is applied to either edge or flange 18,20 of the posts, thereby interrupting heat transmittance transversely thereof. Optionally, supplemental elongated openings, such as the diagonal cut-outs 54 may be included intermediate each adjacent pair of openings 50 and 52, on both sides of the post centerline 46 so that a pair of transverse heat breaks will exist between the two flanges 18,20 along every longitudinal point of the post.

Thus, all of the above openings will be seen to cooperate to provide dual interrupt areas at any transverse area throughout the length of the post, which results in a noticeable retarding of heat transmission from one post flange 18,20 to the other. This, combined with the multiple folds 18*a*,20*a* comprising each flange, provides a significant heat break across the post since the increased mass of the multi layers of the flanges 18,20 amounts to a heat sink at each edge of the post. Further resistance to heat transfer will be described later on.

FIG. 4 best illustrates a typical wall assembly W as constructed by following the basic concepts taught by this invention, with later drawing figures illustrating various alternative post flange configurations and cooperating kerf provisions in the associated wallboards. As is usual, the wall assembly W comprises a first wall 56 parallel to and spaced from a second wall 58, with each wall being formed by a plurality of adjacent, coplanar wallboards 60. Likewise, as is usual, an intermediate stud or post member is employed to support the two walls 56,58 and is adapted to engage the walls in the area of the juncture between each pair of laterally adjacent wallboards 60. However, this support and engagement is achieved in a manner unlike that as heretofore as it will be seen that a particular wallboard edge formation is provided and which cooperates with specific construction of the post to form a positive, rigid interlock between the walls 56,58 and intermediate posts 10.

The wallboards 60 may comprise any well known material such as gypsum, with or without the addition of other materials as is practiced in the art. The opposite lateral edges of each wallboard are respectively formed with first and second edge formations 62 and 64 which from the drawings will be seen to comprise mating male and female configurations allowing of a tongue and groove interlock between adjacent wallboards 60,60. In this respect, the first edge formation 62 includes an axially extending tongue 66, preferably substantially medially disposed relative the inner and outer faces 68,70 of the wallboard. The tongue 66 is formed with an end edge 72 bounded by side edges 74 and 76, each in turn communicating with inner and outer transverse edges 78,80, respectively. As will be seen in the drawings, particularly FIGS. 4–9, the tongue side edge 74 is parallel to the wallboard faces 68,70 while the opposite side edge 76 preferably is inclined outwardly from the end edge 72 to the outer transverse edge 80, such that a tapered tongue 66 is provided.

Each wallboard 60 having the above first edge formation 62 along one vertical edge is provided with the mating second edge formation 64 along its opposite vertical edge. This second edge formation 64 comprises as outwardly directed groove 82 formed with a bottom wall 84 bounded by lateral walls 86,88 which in turn communicate with inner and outer transverse edges 90,92, respectively. The groove lateral wall 88 is preferably inclined outwardly from the groove bottom wall 84, at an angle comparable to the taper of the tongue side edge 76 so that when two wallboards 60,60 are moved together into abutting relationship, a close or snug interlock is achieved between the wallboards when the opposed outer transverse edges 80 and 92 are in direct abutment. From the drawings, it will be observed that a clearance 94 exists between the tongue end edge 72 and the adjacent groove bottom wall 84 when two wallboards are assembled. For reasons which will become apparent hereinafter, the thickness of this clearance 94 is preferably slightly greater than the thickness of the material comprising the post members 10.

The manner of achieving a wall by use of the above described components may now be described, starting with use of the post 10 to arrive at the wall assembly W as depicted in FIG. 4 of the drawings. Initially, a plurality of the posts 10 are erected in a vertical, laterally spaced apart manner with their opposite ends suitably affixed to appropriate cap members, sills or runners (not shown) as is the conventional practice in the erection of studs or posts in a drywall installation. However, unlike some typical constructions, the present posts are intended to be erected solely at the joint or interface between adjacent wallboards, since a vastly superior support or rigidity is obtained by means of the instant construction, thereby obviating the need for posts intermediate each wallboard's vertical edges. When supplemental thermal and sound transmission resistance is not needed, the wallboards may be installed without regards to the assembly of other components which will be described later. The first wall 56 of the assembly W is initiated by erecting one wallboard 60 such that its second edge formation 64 engages one edge flange 18 of the post 10, with this flange disposed within the groove 82 and flush with the groove lateral wall 88. Thence, the other wallboard 60 of the first wall 56 is axially moved toward the already erected wallboard 60, with its tongue 66 entering the groove 82 of the previously erected wallboard 60. The second wallboard is axially urged into tight engagement with the stationary wallboard to achieve the disposition as shown in FIG. 4 whereupon it will be seen that the outer transverse edges 80 and 92 of the two adjacent wallboards are in abutment with the tongue 66 tightly nested within the groove 82. On the opposite or inner side of the tongue, the web 12 of the post is tightly sandwiched between the flushly engaging inner transverse edges 78,90 of the adjacent wallboards. To accommodate the thickness of the post web 12 in this sandwiched relationship, a kerf 96, corresponding in thickness to that of the post web, is provided between the assembled wallboards, by initially forming this relief in either of the wallboard inner transverse edges 78 or 90.

The second wall 58 is assembled by following the same sequence as above with a second pair of laterally adjacent wallboards 60,60 captively engaging the other post edge flange 20 and thereafter results in the completed wall assembly W. In view of the positive longitudinal and transverse interlocking as provided by this assembly, separate, closely spaced fasteners through the tongue and groove area of the wallboards and into the post flanges, are not required. To fully stabilize the wall assembly W, only a minimum number of fasteners would be called for and these would be applied along the top and bottom edges of the wallboards, into the ceiling and floor runners (not shown).

Figure 4B:
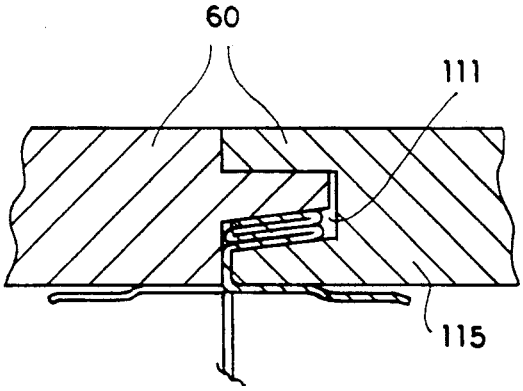
FIG. 4B is a fragmentary sectional view illustrating a modification of the interlock as provided in the assembly of FIG. 4.
Figure 5A:
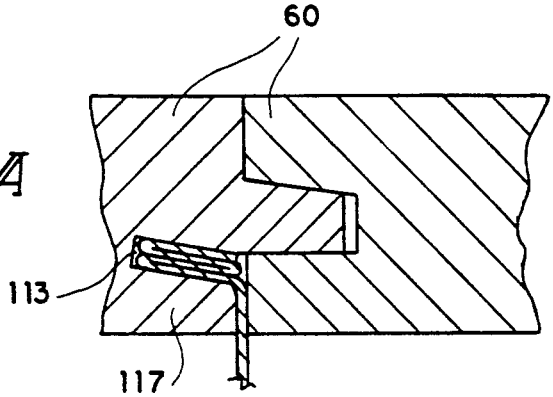
FIG. 5A is a view similar to FIG. 5, illustrating an angled post flange as disposed within a similarly angled wallboard kerf.

With any of the herein described embodiments, the post end flanges may be formed at an outwardly disposed angle with respect to a perpendicular plane passing through the post web 12. That is, instead of being disposed normal to the web, each end flange is inclined outwardly therefrom at an angle of at least 3 degrees or more and preferably at least 5 degrees from the normal plane, as suggested by the flange **18*b* in FIGS. 2A, 4A, 4B and 5A. Not only will this construction allow for a more compact stacking of the posts but more importantly, it permits the use of wallboards 60 having a minimum thickness without loss of strength or integrity. This will be appreciated when it is recognized that normally, the wallboard edge formations 62 and 64 are constructed with a thickness divided into three substantially equally thick portions. The tongue or groove account for one-third of the thickness while the two laterally adjacent portions of each edge formation respectively account for one-third thickness each. Thus, when a kerf or relief area is cut into either wallboard, along an axis parallel to the wallboard surfaces 68, 70 and adjacent either the tongue or groove, the adjacent lateral wallboard portion is significantly reduced in thickness. This may materially weaken the resulting juncture as formed by an inserted post flange. To compensate for this shortcoming, a manufacturer will have to increase the overall thickness of the wallboards, by the thickness of the kerf. By utilizing the angled flanges 18*b* and which are nestled within similarly angularly disposed kerfs or relief areas, the above three times one-third wallboard thickness may be maintained. This is shown in FIGS. 4B and 5A, respectively, wherein the relief area 111 and kerf 113 are angled inwardly toward the center of the wallboard thickness, thereby leaving a progressively increasing thickness to the lateral wallboard portions 115 and 117**.

To enhance the resistance to thermal and sound transmission through the wall assembly W, two additional components may be installed within the interior space S intermediate the two spaced apart walls 56 and 58. First, insulative strips 98 may be assembled in flush engagement with each face of the post webs 12 as shown in FIG. 4. These strips 98 may comprise any well known dimensionally stable composition such as that used for the wallboards 60 and are cut to correspond to the full length of the posts 10 or, may comprise a plurality of end-abutting shorter lengths which when thusly installed, fully mask each web face. A typical thickness of each strip 98 is ¼-½ inch (0.635-1270 cm.) while the width thereof is selected such that the side edges 100, 100 cause the post tab tips 42 to be deflected outwardly as each strip 98 is installed toward a post web 12. After the strip edges 100 are urged past these tab tips 42, they are juxtaposed the respective tab base portions 40, 40 and the strips are retained in position in view of the inward offset of the tab tips 42 as formed by the bend lines 44 thereof. Thus, the post tabs 22, 24, 26, 28 will be seen to have served two distinct functions up to this point. First, they provided guide means facilitating the attachment of both wallboards 60 as they are assembled to each of the post end flanges 18 and 20, while also fortifying the rigidity of the resultant interlocked wallboards and post. Secondly, these same tabs provide resilient, deflectable means for allowing the attachment of the insulative strips 98 to both faces of each post web 12.

Now, still an additional or third function of these tabs will become evident. The maximum R-value and resistance to thermal and sound transmission through the wall assembly W quite obviously can only be achieved when the bulk of the interior space S is modified to offer suitable resistance to sound and heat progression from one wall 56 to the other wall 58. This is most readily accomplished by the installation of appropriate insulative panels or batts 102 comprising any well known insulative material such as glass-fiber, mineral wool or the like and which will include outer faces 104, 104 and end faces 106, most commonly provided by a suitable wrap. Each insulative panel 102, which will be understood to exhibit at least a nominal degree of compressibility, is installed before the second wall 58 is assembled to a post 10, by directing the panel end faces 106 respectively toward each one of two laterally adjacent post webs 12. The panel outer faces 104, 104 are slightly compressed as the end faces 106 are urged between the resilient tips 42 of the post tabs and into abutment with the insulative strips 98. It will be appreciated that the thus installed batts 102 are positively retained in the position of FIG. 4, especially in view of the inturned edge 23 of the plurality of tabs engaging the batt outer face wrap 104.

The improved thermal and sound resistance offered by the instant invention has been demonstrated through testing. In conventional drywall installations, conduction of either type of energy from one wall to the other is obviously facilitated due to the fact that a plurality of mechanical fasteners are driven from each wall outer face, into the post flanges, thereby providing a plurality of metallic transmission paths extending through the wall assembly, from one wall outer face to the opposite wall outer face. Without any barrier within the interior spaces, it is apparent that energy transmission from one wall to the other would meet little resistance since air is recognized as a good conductor. Prior attempts to provide thermal protection by means of insulative batts in a conventional wall assembly have fallen far short of success. It has been demonstrated that when these prior assemblies are subjected to a flame test, as soon as the wallboard of the first wall succumbs to the effect of continuous application of a direct flame and disintegrates, the thus exposed insulative batt is free to collapse or fall out of the opened assembly, thereby instantly fully exposing the inner face of the other wall to the flame and accordingly leading to early complete failure of the wall assembly.

The instant wall assembly W, on the other hand, has been found to exhibit exceptional resistance to thermal and acoustical transmissions from exteriorly of one wall 56 to exteriorly of the other wall 58. The very insulative property of the wallboard composition itself resists conduction of energy to the post flange and web portions captively interlocked within the mass of the wallboard material and acoustic or thermal energy that eventually is conducted to the post webs 12 will be retarded in its transmission to the opposite post flange in view of the flushly engaging, fully overlying insulative strips 98, 98 on either face thereof.

Additionally, the openings 50, 52 and 54, always transversely oppositely disposed from one another, will be seen from FIG. 1 to provide a series of energy breaks throughout the entire length of each post 10 and this feature quite obviously further retards the migration of thermal and acoustical energy from one post flange 18 to the other flange 20. As shown in this drawing figure, a significant amount of planar material exists along the longitudinal extent of the post, between the openings 50 and 52 on each side of the post and were it not for the inclusion of the plurality of diagonal slots 54, a solid extent of transverse metal would exist in these areas. Although an optional feature, the use of these latter slots 54 will be seen to insure that a pair of separate, spaced apart apertures will be present at any transverse point throughout the longitudinal extent of the post, thereby offering a maximum thermal and acoustic break between the opposite post flanges 18, 20.

Reference may be made at this time to a further insulative feature shown in the post 10 of FIG. 4. The plurality of folds 18*a*, 20*a* as provided by the twice double folded material of the flanges 18, 20 again, is an optional feature and is employed not so much to provide a strengthened post flange area but primarily to present an increased mass of material captively locked within each wall 56, 58 and which serves as a heat sink.

FIGS. 5–9 and 21 illustrate alternative embodiments of posts and/or wallboards. It will be understood that with any one embodiment, any or all of the various enhancements as described above in connection with the post 10 may be practiced with the posts shown in the latter drawing figures. The crux of the various alternative assemblies involves modified surfaces on the posts and alternative kerf(s) or relief area(s) within the edge formations of the wallboards.

In the embodiment of FIG. 5, the same post 10 may be used but its assembly with the wallboards 60 is varied so that the post flanges 110 are each initially inserted within a relief area 112 formed in the second edge formation 114, that is, that wallboard edge presenting the tongue 66. When captively interlocked within the fully assembled joint, the post flange 110 is nested within this relief area 112 while the adjacent lateral web portion 114 is tightly engaged within the transverse relief area 96.

In the embodiment of FIG. 6, the post web 12 is modified to provide an inner, longitudinal flange 116, normal to the central web and which joins an offset, transverse web portion 118, from which extends the end flange 120. In this instance, a post 115 is provided wherein the cavity 122 as formed between the parallel flanges 116, 120 serves to captively surround one of the projections 124 as presented by the female edge formation 64 of the wallboard 60. As previously mentioned, any of the posts according to this invention may be provided with the struck out tabs 26 as well as the additional openings as shown in FIG. 1. In the case of the post 115, such tabs would not serve to provide guidance and support of the wallboards 60, 60 since the flanges 116, 120 accomplish this function. However, such tabs 26 would still facilitate positive stacking of the posts 115 and additionally present retention means for subsequently applied insulative strips 98 as well as insulation batts 102.

FIGS. 7 and 8 depict alternative installations utilizing a modified post 126 that, like the post 115, includes a longitudinal inner flange 128 joined to an offset transverse web portion 130 but, the end flange 132 will be seen to project away from the balance of the post rather than serve as a return as in FIG. 6. When such a post 128 is installed as in FIG. 7, the end flange 132 is initially inserted into a kerf or relief area 134 extending rearwardly of the associated wallboard tongue 66 while, in the installation of FIG. 8, this end flange is received within the relief area 136 adjacent the wallboard tongue 66.

Figure 9:
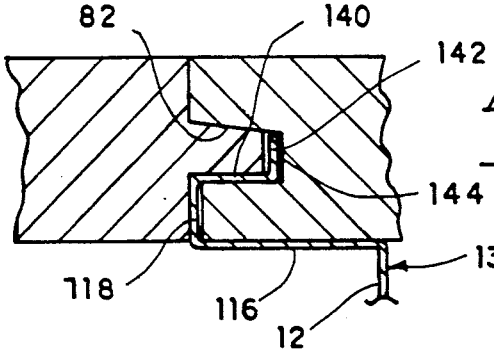

The configuration shown in FIG. 9 is a further modification of the post 115 of FIG. 6 and comprises a post 138 wherein the flange 140 comprises a return flange to which is joined the end flange 142, the latter of which is parallel to the post web 12 and is received within the space 144 formed in the bottom of the wallboard groove 82.

Figure 10:
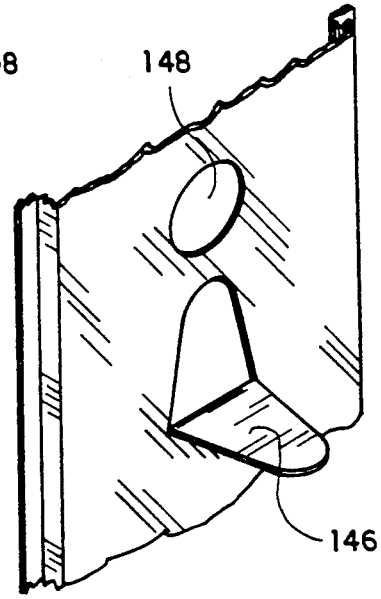
FIG. 10 is a partial perspective view of a post provided with an opening for passage of utility lines and a struck-out barb for supporting insulation material.
Figure 11:
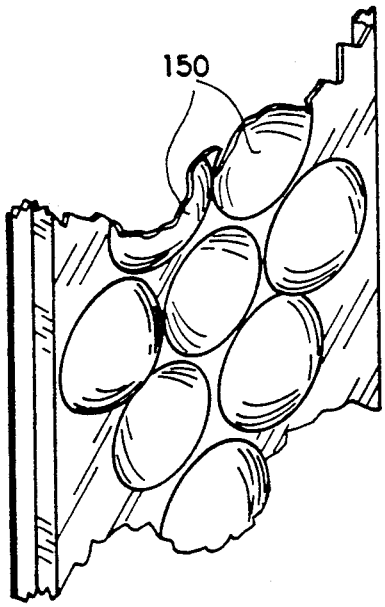
FIG. 11 is a partial perspective view of a post provided with stiffening means in the form of hemispheres alternatively projecting from opposite faces of the post web.

FIGS. 10 and 11 illustrate alternative features of the post webs. In the case of FIG. 10, a struck out barb 146 projecting from one side of the web is shown and provides a horizontal platform adapted to enter into and support insulation batts. By providing a plurality of such barbs 146 on each post and which alternately project from opposite sides thereof, it follows that retention means will be offered for insulation batts on both sides of any one post. Also shown is one of a plurality of openings 148 which provide for the passage of utility lines, such as electrical cable, through the confines of an erected wall system. The modification of FIG. 11 reveals that any post web may be formed with a plurality of adjacent or abutting hemispheres 150, each formed by well known drawing processes and projecting from alternate faces of the web. Such deformations not only provide a reinforcement of the post but also increases the heat insulative factor thereof in view of the increased surface or heat sink area of the resultant web.

Figure 12:
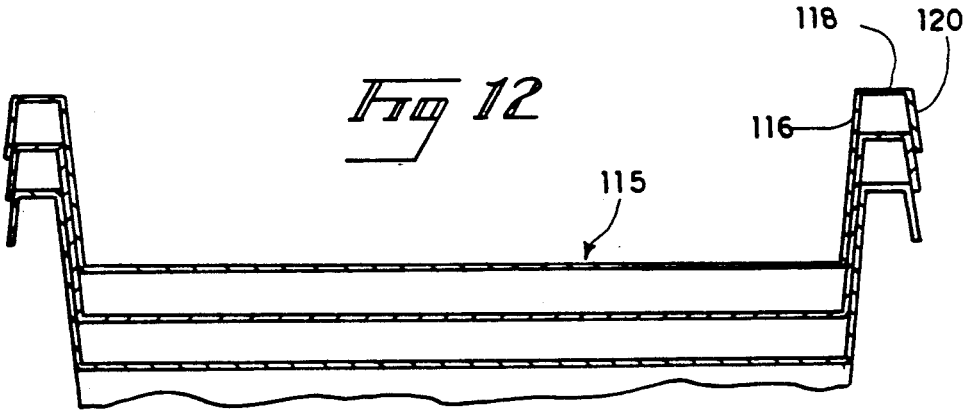
FIG. 12 is an end elevation similar to FIG. 3 and illustrates a stacked array of the posts of FIG. 6.

The post embodiments having the longitudinal inner flanges 116 or 128 likewise lend themselves to ready stacking as will be seen in FIG. 12 wherein a compact, nested condition is achieved. This view also brings out another point. In any of the post embodiments, the end flanges initially may be formed with one or more of the angles a, b or c between the web and flanges or between adjacent flanges, representing less than 90 degrees. In this manner, when the posts are assembled with the wallboards 60-60, the flanges will forced to a normal disposition in view of the wallboard joint kerfs or relief areas and inner wallboard surfaces. This results in a biasing force being applied between the flanges and webs thereby slightly stressing the posts to encourage a tighter fit with the wallboards and discouraging any rattling therebetween.

As an alternative to the struck out tabs 24, any of various other deformations may be utilized to form a stop or guide means insuring a positive, transversely fixed assembly of the posts with the cooperating wallboards 60. FIG. 13 will be seen to show three such types of deformations 152, 154, 156 each of which presents a surface projecting outwardly from the plane of the web 12 and a planar edge 158 spaced from the post end flange 18 or 20, a distance calculated to closely capture the cooperating wallboard. This arrangement is particularly suitable when employing the current concept to form a floor joist or a ceiling.

A modified post construction is shown in FIGS. 14 and 15 wherein the post comprises a plurality of diamond-shaped members 160 each having four peripheral flanges 162 and which are arranged in alternating diagonal directions to form the post 164 of FIG. 14.

A modified heat break may be provided in any one of the instant posts according to the concept shown in FIG. 16 wherein one or both sides of the post 166 is formed with a plurality of substantially extended cutout areas 168, leaving the equally spaced apart end flanges 170 accounting for approximately one-fifth the original extent of the edges of the post.

The basic interlocking or captive feature of the present posts may be employed to provide wallboard attaching clips 172 such as illustrated in FIG. 16. Each said clip 172 comprises a Z-shaped member having a web 174 joined to an edge flange 176 and which is adapted to be inserted within a wallboard kerf 112 as in the assembly of FIG. 5. The clips 172 are attachable to a stud, post or the like by the application of suitable fasteners through a hole 178 provided in an opposite mounting flange 180.

In all instances, it is intended that the end flanges of the respective posts will present a close sliding fit when inserted into the cooperating kerf or relief area of the wallboards. To enhance this interfitting of the posts and wallboards, any of the end flanges, such as 18 and 20, may be roughened as at 182 in FIG. 18, and/or subsequently provided with an adhesive. In this regards, it follows that any of the post flanges disclosed herein may be coated with an adhesive prior to the final assembly operation, in order to further enhance the security of the resultant wall assembly.

Figure 19:
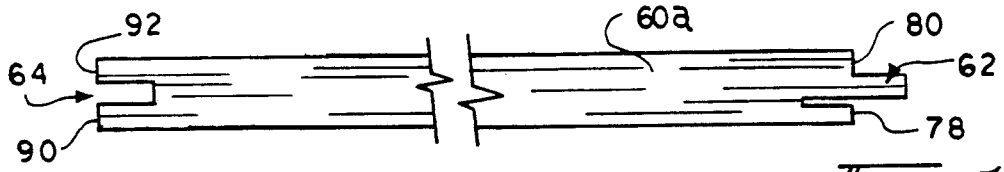
FIGS. 19 and 20 are top plan views of wallboards having alternative edge formations.
Figure 20:
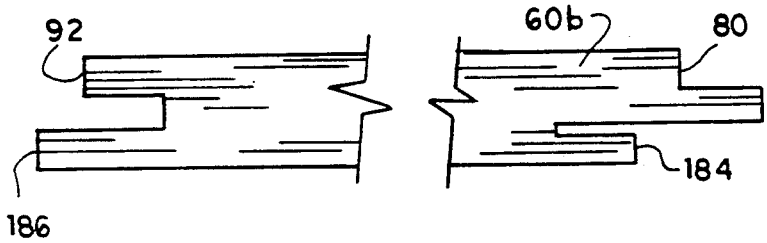

FIGS. 19 and 20 depict the basic tongue and groove configurations usable with the present posts. In the case of the wallboard **60*a* of FIG. 19, the inner and outer transverse edges 78, 80 of the first edge formation 62 will be seen to be coplanar, as are the inner and outer transverse edges 90, 92 at the opposite second edge formation 64. Thus, these wallboards are similar to those as used in the assemblies of FIGS. 5 and 7. The configuration of FIG. 20 departs from the above in that the inner transverse edge 184 is set back or foreshortened while the opposite, inner transverse edge 186** is equally extended or lengthened. With this latter arrangement, a somewhat stronger wall assembly may be achieved since the attachment of the post occurs at a point more further removed from the distal portion of the interlocking wallboard edge formations.

Figure 21:
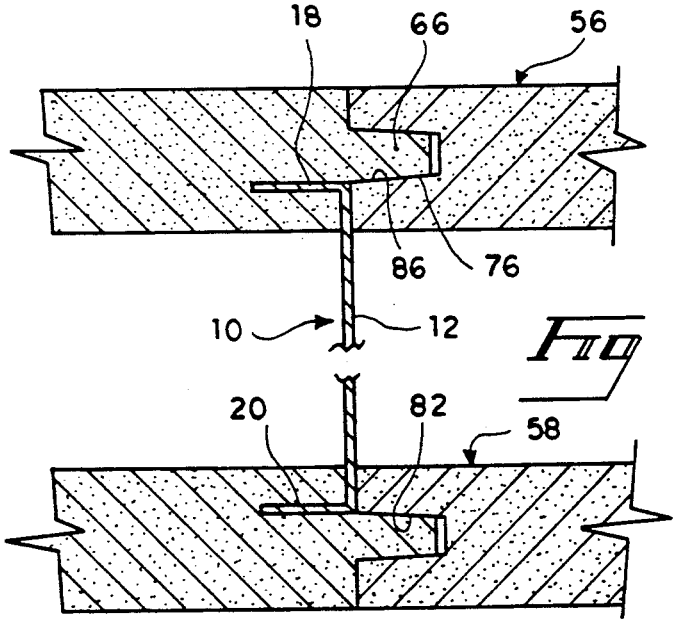
FIG. 21 is a view similar to FIG. 4 but wherein an alternative interlock between the post flanges and wallboards is shown.

The enlarged view of FIG. 21 most clearly depicts another variable possible with the present wallboards and posts. With either of the wallboards shown in FIGS. 19 and 20, the tongue and grooves may be of mating rectangular configuration, as diagrammatically shown in these views. However, it is preferable that each tongue 66 and groove 82 exhibit a slight tapered configuration when viewed in top plan. This may be achieved, as in FIGS. 4–9, by inwardly inclining one tongue side edge 76 with a corresponding taper to the juxtaposed groove lateral wall 86, thereby insuring the tightest fit as two adjacent wallboards 60 are assembled, with or without the inclusion of glue. The assembly of FIG. 21 shows an alternative wherein the cooperating edge formations are symmetrical, in that the tongue and grooves are medially disposed and each includes inclined surface on both sides thereof.

Figure 22:
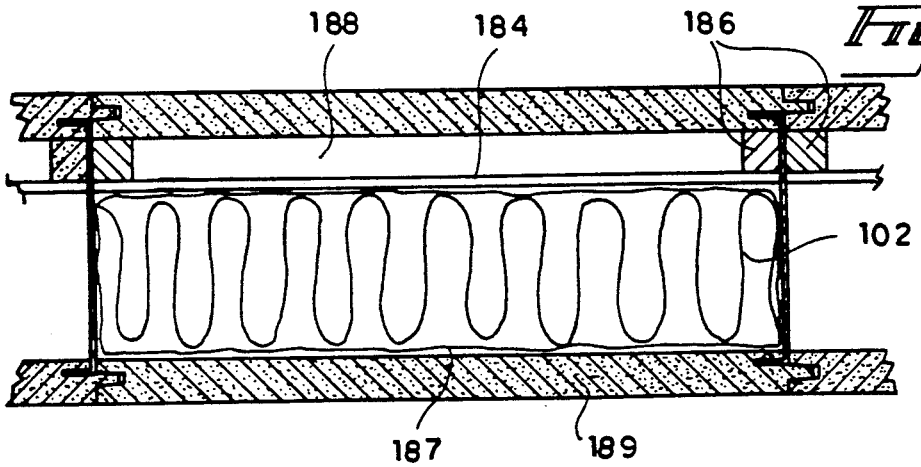
FIG. 22 is horizontal sectional view of an alternative wall assembly including an air conduit, insulation batt and vapor barrier.

Walls according to the above embodiments may be further modified either to provide additional insulation, as in the case of exterior walls, or to allow for the distribution of heated and cooled air, without departing from the basic concepts already presented. As shown in FIG. 22, the inner space S may be further divided, by the installation of longitudinally extending sheet stock 184, suitably affixed to spacer strips 186, so that a chamber 188 is formed between each pair of so-equipped adjacent posts 10. A suitable vapor barrier 187 is included intermediate the insulation batt 102 and inner wall 189.

Figure 23:
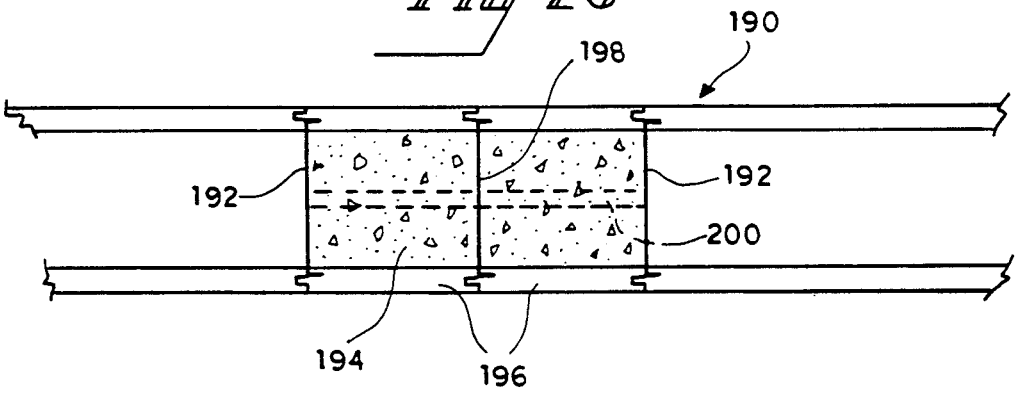
FIG. 23 is a horizontal sectional view illustrating the instant wall assembly as used to provide a form for the in-situ erection of a concrete wall.

Although the wall assemblies W as described herein are primarily intended to provide interior or non-load bearing walls, the very same construction may be employed to achieve load bearing structures. FIG. 23 illustrates the use of any of the above related walls as a form or mold, to produce a monolithic concrete wall assembly 190. This is accomplished by using posts 192 having imperforate webs to define the lateral limits of the concrete 194 which is then poured therebetween to provide a solid fill bounded by the posts and wallboards. To withstand the outward forces created by the poured concrete, the wallboard panels 196 are preferably made up of non-standard or narrower widths as shown and intermediate posts 198 are provided with an open profile (not shown) to allow migration of the poured concrete therethrough as well as to accommodate alternative reinforcing bars 200.

It is to be understood that the present invention is not limited solely to the embodiments described above, but encompasses any and all embodiments within the scope of the following claims.

We claim:

1. A building assembly comprising;

a pair of walls each including a plurality of wallboards each in turn provided with parallel inner and outer faces and opposite first and second edge formations, said first and second edge formations comprising disparate configurations permitting of a mating interlocking juncture between adjacent ones of said wallboards, each said edge formation including inner and outer transverse edges, a tongue projecting outwardly from each said first edge formation intermediate said first edge formation inner and outer transverse edges, each said second edge formation including an inwardly directed groove disposed intermediate said second edge formation inner and outer transverse edges, said tongue and groove medially disposed between said wallboard inner and outer faces, an elongated post disposed between said pair of walls intermediate said junctures, said post including a web and having two opposite flanges, a relief area within at least one said wallboard edge formation and disposed between said wallboard inner and outer faces, said pair of walls maintained in a rigid spaced apart parallel disposition with said post web intermediate opposed ones of said wallboard inner faces and said post opposite flanges captively disposed within respective ones of said relief areas as tight interlocking junctures are formed by pairs of said wallboards in each said wall.

2. A building assembly according to claim 1 wherein, each said second edge formation groove includes a pair of opposed lateral walls, and said relief area is provided adjacent one said groove lateral wall.

3. A building assembly according to claim 1 wherein, said tongue and groove include opposite lateral walls, and at least one said wall of each said tongue and groove are tapered.

4. A building assembly according to claim 1 wherein, said post web includes opposite faces, and a plurality of tabs projecting substantially normal from each said web face.

5. A building assembly according to claim 1 wherein, said post web includes a plurality of elongated openings, and said openings disposed in transversely opposed pairs throughout the longitudinal extent of said post to provide at least a pair of thermal breaks along any transverse axis of said post.

6. A building assembly according to claim 1 wherein, said post opposite flanges comprise the distal portions of said post.

7. A building assembly according to claim 1 wherein, said post opposite flanges comprise multi-folded layers of material.

8. A building assembly according to claim 1 wherein, said post opposite flanges initially extend from said web at an angle other than normal and when captively disposed within said relief areas, are normal thereto, whereby said web is stressed to reduce rattling.

9. A building assembly according to claim 1 including, a longitudinal inner flange on opposite sides of said post web and intermediate said opposite flanges and web, and said longitudinal inner flanges flushly engageable with said wallboard inner faces.

10. A building assembly according to claim 1 wherein, said post web includes opposite faces, resilient holding means projecting from said web opposite faces and spaced inwardly from said opposite flanges, an interior space formed within said assembly intermediate said wallboard inner faces and between adjacent ones of said posts, an insulation batt having opposite end faces disposed within said space, and said insulation batt end faces engaged and retained between opposed ones of said holding means projecting from each said web face.

11. A building assembly according to claim 1 wherein, said wallboard first edge formation inner and outer transverse edges are substantially coplanar, and said wallboard second edge formation inner and outer transverse edges are substantially coplanar.

12. A building assembly according to claim 1 wherein, said post flanges are disposed at an outward angle greater than normal to said web, and said relief areas are provided in said wallboards at an angle comparable to said flange outward angle.

13. A building assembly according to claim 1 wherein, said post flanges are disposed at an angle normal to said web.

14. A building assembly according to claim 1 wherein, said wallboard first edge formation inner and outer transverse edges are disposed in dissimilar transverse planes, and said wallboard second edge formation inner and outer transverse edges are disposed in dissimilar transverse planes.

15. A building assembly according to claim 1 wherein, said post web includes opposite faces, resilient holding means projecting from said web opposite faces and spaced inwardly from said opposite flanges, and rigid insulative strips flushly engaging said web opposite faces and having side edges retained in position by engagement with said holding means.

16. A building assembly according to claim 3 wherein, said tapered lateral walls are adjacent said wallboard outer faces.

17. A building assembly according to claim 4 wherein, said tabs are struck out from said web to provide adjacent openings in said web, whereby said posts are stackable upon one another with said tabs of one said post insertable through said openings of a next adjacent one said post.

18. A building assembly according to claim 4 wherein, each said tab includes a base portion integral with a slightly inwardly offset tip portion.

19. A building assembly according to claim 4 wherein, said tabs are parallel to and slightly spaced from said opposite flanges, and said web includes an elongated opening transversely opposite each said tab and similarly slightly spaced from an adjacent one said opposite flange.

20. A building assembly according to claim 5 wherein, said openings include longitudinally extending openings adjacent said opposite flanges, and diagonally extending openings intermediate said longitudinally extending openings.

21. A building assembly according to claim 9 wherein, said longitudinal inner flanges extend the full length of said post.

22. A building assembly according to claim 10 wherein, said resilient holding means comprises tabs struck out from said web and having inturned distal edges engageable with said insulation batts.

* * * * *